United States Patent [19]

Anselmino et al.

[11] Patent Number: 4,709,488

[45] Date of Patent: Dec. 1, 1987

[54] VENTURI AIR VENT FOR DISHWASHER

[75] Inventors: Jeffrey Anselmino, Pipestone Township, Berrien County; Scott D. Slabbekoorn, St. Joseph Township, Berrien County, both of Mich.

[73] Assignee: Whirlpool Corporation, Benton Harbor, Mich.

[21] Appl. No.: 893,942

[22] Filed: Aug. 6, 1986

[51] Int. Cl.[4] ..... F26B 25/12

[52] U.S. Cl. ..... 34/235; 34/133; 312/213; 126/198

[58] Field of Search ..... 34/235, 133, 234; 134/104, 154, 182, 183; 312/213; 126/198, 193

[56] References Cited

U.S. PATENT DOCUMENTS 3,588,213 6/1971 Braga et al. ..... 34/234
3,876,469 4/1975 Schimke ..... 134/95
4,179,821 12/1979 Herbst et al. ..... 34/235
4,247,158 1/1981 Quayle ..... 312/213

*Primary Examiner*—Larry I. Schwartz
*Attorney, Agent, or Firm*—Wood, Dalton, Phillips, Mason & Rowe

[57] ABSTRACT

A venturi structure mounted in an upper portion of the front door of the drying chamber of an apparatus, such as a dishwasher, arranged to provide both mixing of dry ambient air with moist air being delivered from the drying chamber, and the provision of a barrier layer juxtaposed to at least one surface portion of the mixed dry air and moist air discharge stream to provide further reduction in potential condensation of moisture from the drying chamber by the air stream impinging on cool surfaces exteriorly adjacent the drying chamber door.

16 Claims, 5 Drawing Figures

FIG. 1
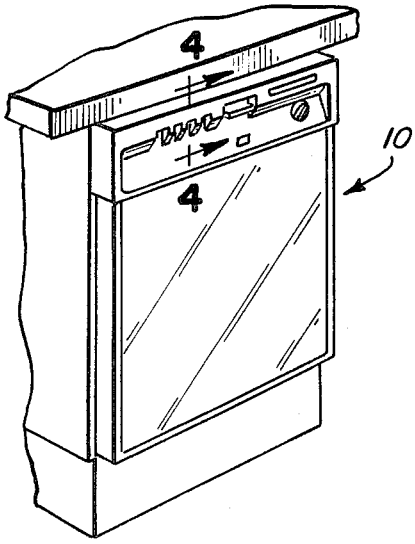
FIG. 2
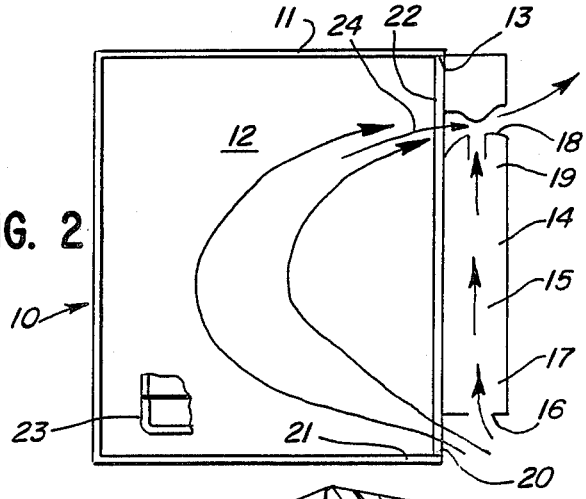
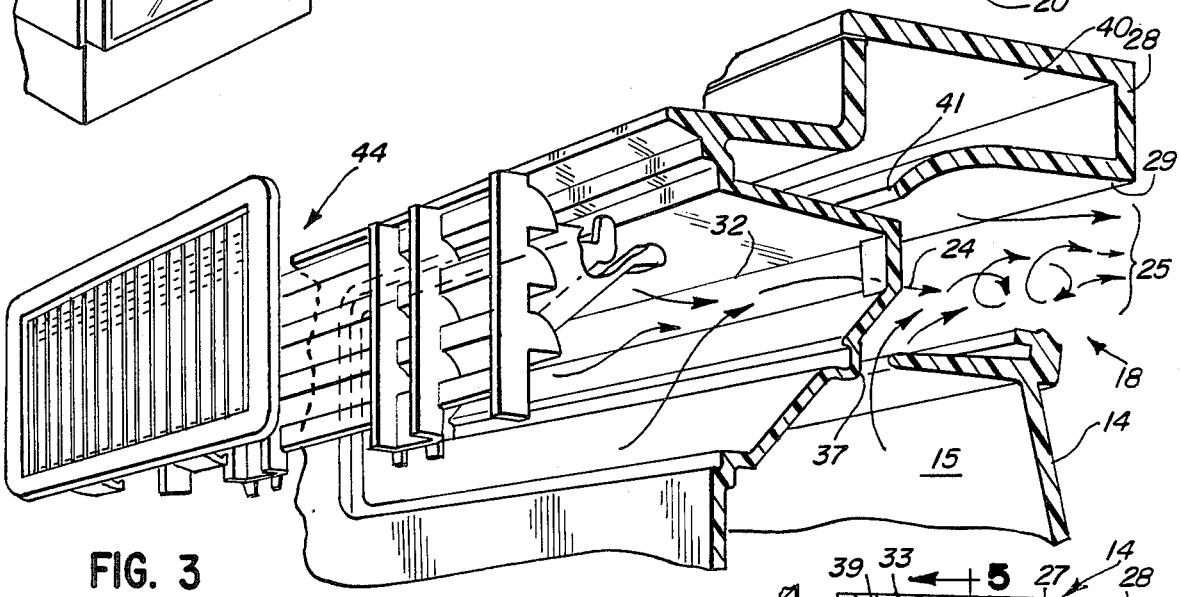
FIG. 3
FIG. 4
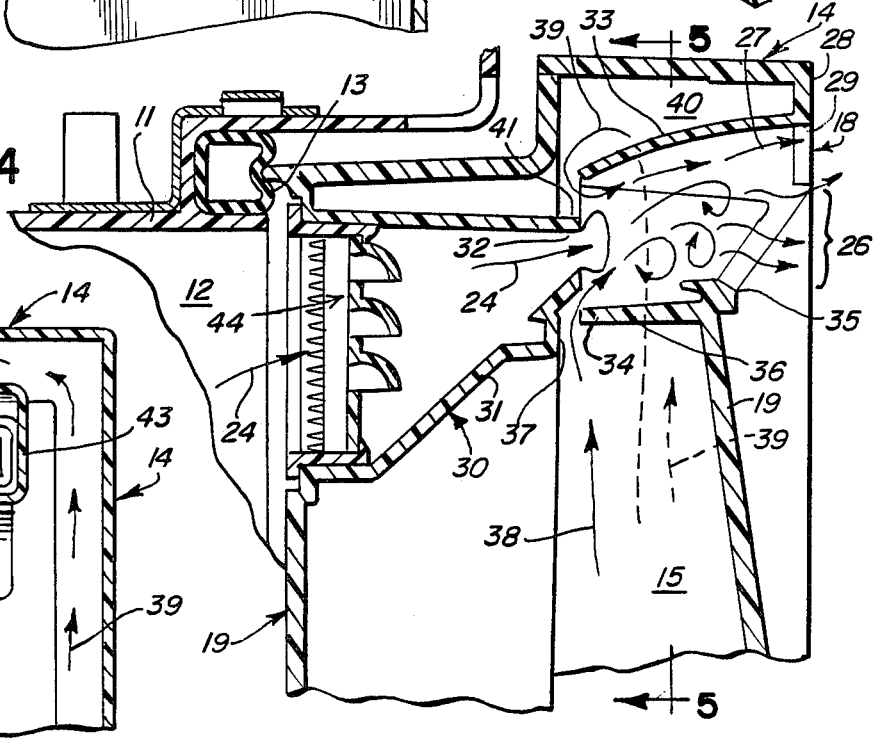
FIG. 5
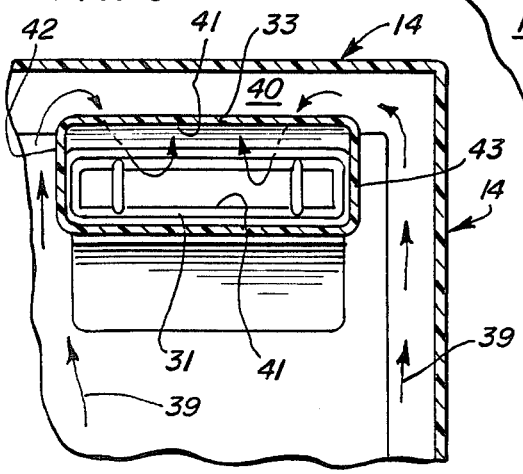

VENTURI AIR VENT FOR DISHWASHER

BACKGROUND OF THE INVENTION

1. Field of the Invention

This invention relates to washing and drying apparatus, such as dishwashers, and more specifically to means for exhausting moist air from the dishwashing chamber thereof.

2. Description of the Background Art

It is desirable to prevent condensation of moisture on exposed surfaces from the air being discharged from a dishwashing chamber as during the drying cycle.

As disclosed in U.S. Pat. No. 3,588,213 of Albert T. Braga, which patent is owned by the assignee hereof, one solution to this vexatious problem has been to provide for an air flow of dry ambient air superjacent the stream of moist air being discharged from the dishwasher chamber vent. The layer of the dry ambient air on top of the moist air prevents the moist air from impinging on the adjacent console and, thus, effectively prevents condensation of moisture from the moist air thereon.

It is further conventional to provide means for mixing dry ambient air with the moist air from the dishwashing chamber so as to reduce the tendency for condensation of the moisture on the console, or other surfaces impinged on by the discharged stream of moist air.

SUMMARY OF THE INVENTION

The present invention comprehends an improved means for preventing condensation of moisture from the discharged moist air stream, wherein both mixing of dry ambient air with the moist air stream and the provision of a protective barrier adjacent a surface portion of the stream are effected.

More specifically, the invention comprehends providing venturi means at the outlet vent from the dishwasher chamber and means for delivering dry ambient air to the venturi means so as to provide both mixing of a portion of the dry ambient air with the moist air being delivered through the venturi means from the dishwashing chamber and a portion of the dry ambient air as a barrier layer along a surface portion of the moist air stream.

More specifically, the invention comprehends the provision in apparatus having means defining a washing and drying chamber, means defining an outlet from said chamber, means for effecting flowing of air into and through the chamber to absorb moisture therein, and flow of the air outwardly through said outlet as a stream of moist air, and a wall member adjacent the chamber and having an air flow passage extending therethrough, of improved means for preventing condensation from the moist air stream on cool surfaces adjacent the discharge vent of the dishwashing chamber.

The invention is advantageously adapted for use with undercounter dishwashers and the like, wherein moist air is discharged through a forwardly opening outlet. In such installation, it is highly desirable to prevent the condensation of moisture on exposed surfaces at the outlet, such as the grill normally provided across the outlet opening.

In the illustrated embodiment, the wall member adjacent the chamber having the air flow passage extending therethrough may comprise the vertical front door of the dishwasher, with the ambient air flowing upwardly through the door to adjacent the washing and drying chamber outlet for association with the moist air stream thereat.

In the illustrated embodiment, the wall member defined by the front door is in heat transfer association with the washing and drying chamber so that the air flowing upwardly therethrough is heated thereby.

In the illustrated embodiment, the venturi means includes an upstream means converging the moist air flow from the washing and drying chamber, and means downstream of the upstream means diverging the moist air flow. The means for delivering the dry air from the wall member comprises passage means opening into the diverging venturi means.

In the illustrated embodiment, the means for effecting convective flow of air into one end of the chamber comprises means for heating the air in the chamber.

The improved apparatus of the invention is extremely simple and economical of construction while yet providing the highly improved condensation minimizing functioning discussed above.

BRIEF DESCRIPTION OF THE DRAWING

Other features and advantages of the invention will be apparent from the following description taken in connection with the accompanying drawing wherein:

FIG. 1 is a fragmentary perspective view of an apparatus embodying the invention;

FIG. 2 is a diagrammatic longitudinal section thereof illustrating the flow of the air through the washing and drying chamber of the apparatus and the concurrent flow of air through the wall member front door of the apparatus;

FIG. 3 is a fragmentary sectional perspective view illustrating in greater detail the flow of the two air streams at a venturi means in the discharge portion thereof;

FIG. 4 is a fragmentary vertical section taken substantially along the line 4—4 of FIG. 1; and FIG. 5 is a fragmentary transverse vertical section taken substantially along the line 5—5 of FIG. 4.

DESCRIPTION OF THE PREFERRED EMBODIMENT

In the illustrative embodiment of the invention as disclosed in the drawing (FIGS. 1 and 2), an apparatus embodying the invention, generally designated 10, is shown to comprise a dishwasher apparatus having a tub 11 defining a washing and drying chamber 12 having a front opening 13 selectively closed by a door 14. Door 14 comprises a hollow wall member having an internal flow passage 15, with an inlet 16 at a lower portion 17 of the door, and an outlet 18 at an upper portion 19 of the door.

Air is passed convectively through chamber 12 from an inlet 20 at a lower front portion 21 of the tub, and outwardly from the chamber 12 through the door outlet 18 communicating with the chamber 12 at an upper portion 22 of the tub.

Support means generally designated 23 are provided within the chamber 12 for supporting dishes, glassware, silverware, etc., during the washing and drying operations within apparatus 10. In carrying out the drying operation, ambient air is delivered through the inlet 20 to flow over the hot articles on support 23, absorb remaining moisture therefrom, and exit as a stream of moist air 24 through the outlet 18.

As indicated briefly above, and illustrated in FIGS. 3–5, the invention comprehends a novel association of dry ambient air with the moist air stream 24 to provide a discharge 25 from outlet 18 which includes a first portion 26 comprised of turbulently mixed ambient dry air and moist air, and a juxtaposed layer 27 of dry ambient air defining a barrier against impingement of the mixed moist air on the exposed surfaces, such as surfaces 28 and 29 defining the outlet 18 in the upper portion of the door.

As best seen in FIGS. 3 and 4, outlet 18 is defined by a venturi structure generally designated 30 mounted within the upper portion 19 of the door. The venturi device includes a rear portion 31 having a grill 44 extending transversley thereacross through which the moist air stream 24 from chamber 12 enters the venturi.

As best seen in FIG. 4, the inlet portion 31 of the venturi comprises a converging portion having its small cross section outlet 32 opening into a front portion 33 of the venturi. Venturi front portion 33 defines a forwardly diverging portion. The small cross section front opening 32 of the rear venturi portion 31 opens directly into the small cross section rear end 34 of the venturi front portion 33, and the large cross section front end 35 opens through the front of the door for discharging the air stream into the ambient space forwardly of the dishwasher.

As best seen in FIG. 4, a lower wall portion 36 of the venturi front portion 33 is provided with a transfer opening 37 through which the dry ambient air stream 38 flowing upwardly through door passage 15 exits from the upper portion 19 of the door into the diverging venturi portion 33.

Thus, as illustrated in FIGS. 3 and 4, a suction is produced by the flow of the moist air 24 through the narrow outlet 32 of the rear venturi portion opening into the diverging front venturi portion 33 adjacent the opening 37.

As shown in FIGS. 3 and 4, the reaction between the two streams, 24 and 38, causes a turbulent mixing thereof so as to define the mixed stream portion 26. This portion has a reduced moisture percentage as a result of the mixing of the dry ambient air from stream 38 therewith, thereby effectively minimizing the tendency for condensation on adjacent cooler surfaces.

The invention further comprehends the provision of a second portion 39 of the dry ambient air flowing upwardly through door passage 15 in the form of a barrier layer 27 overlying the mixed discharge portion 26.

More specifically, as illustrated in FIGS. 3, 4 and 5, the upper end of the door defines an uppermost plenum 40 receiving the dry ambient air portion 39 and discharging it into the diverging venturi portion 33 through a rear opening 41 overlying the front outlet 32 of the rear venturi portion 31.

Thus, the barrier dry air layer 27 effectively precludes condensation of moisture from the mixed air stream 26 on the superjacent cooler surfaces. The mixture of the dry air from door stream 38 with the moist air stream 24 to form the mixed air stream 26 lowers the relative humidity of the portion 26 so that there is also less tendency for condensation on objects on which that portion of the discharge air impinges.

As shown in FIG. 5, the air delivery 39 upwardly through door 14 flows around the opposite sides 42 and 43 of venturi portion 33 to pass through rear opening 41 for mixture with the moist air stream 24 being delivered through opening 41 in the front end of the rear venturi portion 31.

Thus, the present invention comprehends an improved method of minimizing condensation on surfaces exterior of the front portion of a drying device, such as a dishwasher by providing both reduced humidity conditions in a first portion of the discharge air stream and a barrier layer of low humidity air juxtaposed to at least one portion of the moist air stream as it leaves the discharge opening of the apparatus. The provision of the dry air to be mixed with the moist air from the drying chamber and the provision of the dry air to form the barrier layer are effected by means of an improved venturi structure cooperating with the convective discharge of the moist air from the drying chamber. Thus, the improved apparatus is extremely simple and economical of construction while yet providing an improved condensation reducing operation.

The foregoing disclosure of specific embodiment is illustrative of the broad inventive concepts comprehended by the invention.

I claim:

1. In an apparatus having means defining a drying chamber, means defining an outlet in communication with said drying chamber, means for effecting flow of air into and through the drying chamber to absorb moisture therein and flow of the air outwardly from the drying chamber through said outlet as a stream of moist air, and a wall member adjacent said drying chamber and having a dry air flow passage extending therethrough, the improvement comprising:

venturi means with a converging inlet portion and a diverging outlet portion to develop a low pressure suction zone, said air with absorbed moisture from the drying chamber flowing from the drying chamber through said venturi means to said outlet;

first means for delivering air from said dry air flow passageway as an incident of a pressure differential between the dry air flow passageway and suction zone to said suction zone for mixture with the air with absorbed moisture in the venturi means; and second means separate from said first means for delivering air from said dry air flow passage to said low pressure suction zone against said moist air stream as a layer juxtaposed to a surface portion of said moist air stream as an incident of a pressure differential between the air flow passage and the suction zone, whereby said layer acts as a barrier preventing undesired delivery of said moist air to outwardly of said barrier.

2. The apparatus of claim 1 wherein said drying chamber is provided with means for holding dishware and the like.

3. The apparatus of claim 1 wherein said wall member air flow passage extends substantially vertically and said means for delivering air from said wall member air flow passage comprises a discharge opening at a top portion of said wall member passage.

4. In an apparatus having means defining a drying chamber, means defining an outlet in communication with said drying chamber, means for effecting flow of air into and through the drying chamber to absorb moisture therein and flow of the air outwardly from the drying chamber through said outlet as a stream of moist air, and a wall member adjacent said drying chamber and having a dry air flow passage extending therethrough, the improvement comprising:

venturi means with a converging inlet portion and a diverging outlet portion to develop a low pressure suction zone, said air with absorbed poisture from the drying chamber flowing from the drying chamber through said venturi means to said outlet;

means for delivering air from said dry air flow passageway as an incident of a pressure differential between the dry air flow passageway and suction zone to said suction zone for mixture with the air with absorbed moisture in the venturi means; and means for delivering air from said dry air flow passage to said low pressure suction zone against said moist air stream as a layer juxtaposed to a surface portion of said moist air stream as an incident of a pressure differential between the air flow passage and the suction zone, whereby said layer acts as a barrier preventing undesired delivery of said moist air to outwardly of said barrier, said means for effecting flow of said moist air stream comprising means for directing said stream substantially horizontally, said means for delivering air from said wall member air flow passage comprising means for delivering said air as a layer on top of said stream.

5. The apparatus of claim 1 wherein said means for effecting flow of said moist air stream comprises means for directing said stream substantially horizontally and said means for delivering dry air from said wall member air flow passage comprises means for delivering a portion of said air into said stream from below said stream to mix therewith in the venturi means.

6. The apparatus of claim 1 wherein said means for effecting flow of said moist air stream comprises means for directing said stream substantially horizontally and said means for delivering air from said wall member air flow passage comprises means for delivering said air upwardly around opposite side portions of said stream to above said stream and onto said stream to define a layer on top of said stream.

7. The apparatus of claim 1 wherein said outlet is provided in an upper portion of said wall member.

8. In an apparatus having means defining a drying chamber, means defining an outlet in communication with said drying chamber, means for effecting convective flow of air into and through the drying chamber to absorb moisture therein and flow of the air outwardly from the drying chamber through said outlet as a stream of moist air, and a wall member adjacent said drying chamber and having a dry air flow passage extending therethrough, the improvement comprising:

venturi means with a converging inlet portion and a diverging outlet portion to develop a low pressure suction zone, said air with absorbed moisture from the drying chamber flowing from the drying chamber through said venturi means to said outlet;

first means for delivering air from said dry air flow passageway as an incident of a pressure differential between the dry air flow passageway and suction zone to said suction zone for mixture with the air with absorbed moisture in the venturi means; and second means separate from said first means for delivering air from said dry air flow passage to said low pressure suctin zone against said moist air stream as a layer juxtaposed to a surface portion of said moist air stream as an incident of a pressure differential between the air flow passage and the suction zone, whereby said layer acts as a barrier preventing undesired delivery of said moist air to outwardly of said barrier.

9. The apparatus of claim 8 wherein said wall member is in heat transfer association with said drying chamber and air in said wall member air flow passage is caused to flow therethrough in part by convection to said means for delivering said air from said wall member to said suction zone.

10. The apparatus of claim 8 wherein said outlet defines a horizontally elongate opening.

11. The apparatus of claim 8 wherein said outlet defines a horizontally elongate opening having a ratio of length to height of approximately 6 to 1.

12. The apparatus of claim 8 wherein said means for delivering air from the wall member comprises passage means opening into said diverging outlet portion.

13. The apparatus of claim 8 wherein said apparatus comprises a dishwasher.

14. The apparatus of claim 8 wherein said means for effecting convective flow of air into and through the drying chamber comprises means for heating the air in said drying chamber.

15. In a dishwasher having a dishwashing chamber, a door for selectively closing said chamber, and an air vent through said door for allowing warm moist air to exit said chamber when said dishwasher is in a drying portion of a dishwashing cycle, said air vent comprising:

means in said door forming a first air flow path having an entrance at the bottom of said door and an exit adjacent said air vent means;

means forming a second air flow path having an entrance at the bottom of said door and an exit into said dishwashing chamber adjacent the bottom of said door;

a converging nozzle and a diverging nozzle defining an entrance adjacent the top of said door, said converging nozzle having an inlet within said dishwashing chamber and an exit within said entrance to the diverging nozzle, said diverging nozzle entrance surrounding said converging nozzle exit and being spaced transversely outwardly therefrom to form an entrance for air exiting said first flow path, said diverging nozzle having an exit from said door downstream of said converging nozzle entrance; and heating means within said dishwashing chamber for heating the air and any water therein, whereby dry air flows inwardly through said second flow path into said dishwashing chamber, is heated by said heater, and flows outwardly sequentially through said converging nozzle and said diverging nozzle, and air flowing through said first flow path is mixed with said air flowing from said dishwashing chamber at the entrance to the diverging nozzle by the low pressure effect caused by the cooperating converging and diverging nozzles.

16. The dishwasher of claim 15 wherein said nozzles cooperatively define venturi means.

* * * * *